US006079686A

United States Patent [19]

Reed

[11] Patent Number: 6,079,686

[45] Date of Patent: Jun. 27, 2000

[54] TRAY SUPPORT APPARATUS

[76] Inventor: Dewayne Reed, 15724 Lyons Valley Rd., #22, Jamul, Calif. 91935

[21] Appl. No.: 09/103,634

[22] Filed: Jun. 23, 1998

[51] Int. Cl.[7] ..... A47K 1/08

[52] U.S. Cl. ..... 248/312.1

[58] Field of Search ..... 248/121, 301, 248/309.1, 312.1, 313, 310, 311.2, 223.41, 225.11, 346.5, 128.1; 211/71.01; 47/39, 66.1, 66.7, 68, 67, 71

[56] References Cited

U.S. PATENT DOCUMENTS

| | | | |
|---|---|---|---|
| 1,446,036 | 2/1923 | Dodd | 211/85.17 |
| 1,955,476 | 4/1934 | Torgersen | 248/208 |
| 2,187,159 | 1/1940 | Koch | 248/121 |
| 2,427,416 | 9/1947 | Petersen | 248/312.1 |
| 4,071,976 | 2/1978 | Chernewski | 47/39 |
| 4,422,610 | 12/1983 | Hunt | 248/311.2 |
| 4,559,738 | 12/1985 | Helfman | 47/67 |
| 4,896,456 | 1/1990 | Grant | 47/67 |
| 5,405,116 | 4/1995 | Shepherd et al. | 248/312.1 |
| 5,711,433 | 1/1998 | Smith | 211/71 |

*Primary Examiner*—Anita M. King
*Attorney, Agent, or Firm*—Henri J. A. Charmasson; John D. Buchaca

[57] ABSTRACT

A display structure for flower pots, decorative vases and other similar containers comprises a series of tray-and-pot-holding brackets detachably secured to a mounting panel. Each holding bracket is formed by a plate having, along opposite edges, notches shaped and dimensioned to capture the brims of trays and containers.

15 Claims, 3 Drawing Sheets

TRAY SUPPORT APPARATUS

FIELD OF THE INVENTION

The instant invention relates to holding brackets particularly intended to mount pots, vases as well as plates and trays against a vertical surface, and to display stands for a variety of goods.

BACKGROUND OF THE INVENTION

The display of potted plants requires that they be set on top of tables, shelves, credenzas, or stands that can occupy considerable floor space always in short supply in the confined area of a small apartment, patio or balcony. A ceiling, and especially one into which a hook can be driven is not always available. Accordingly there is a need for a new approach in the display of plants, and other decorative articles around living quarters that does not compete for floor space with the occupants. The instant invention results from a search for a universal and versatile display structure that can easily be adapted to a variety of objects such as candles, art pieces, vases and other such type of furnishing.

SUMMARY OF THE INVENTION

The principal and secondary objects of the invention are to provide a versatile holding bracket for trays, plates and other such supporting devices upon which pots, vases, candles and similar items can be mounted, and a variety of means for securing the bracket to walls, ledges, rails, and other structure commonly found around living quarters.

These and other valuable objects are achieved by a mounting structure consisting essentially of a plate having along a lateral edge a first notch shaped and dimensioned to capture and hold the brim of a plate or tray, and a second notch above the first one shaped and dimensioned to securely capture and hold the brim of a pot or vase positioned upon say plate or tray. A variety of configurations along the other edges of the plate allow for securing the plate to diverse surrounding structures. A mounting stand is also provided that can hold and displays large numbers and sizes of potted plants over a very limited floor space.

DESCRIPTION OF THE PREFERRED EMBODIMENTS OF THE INVENTION

Figures 1, 2:
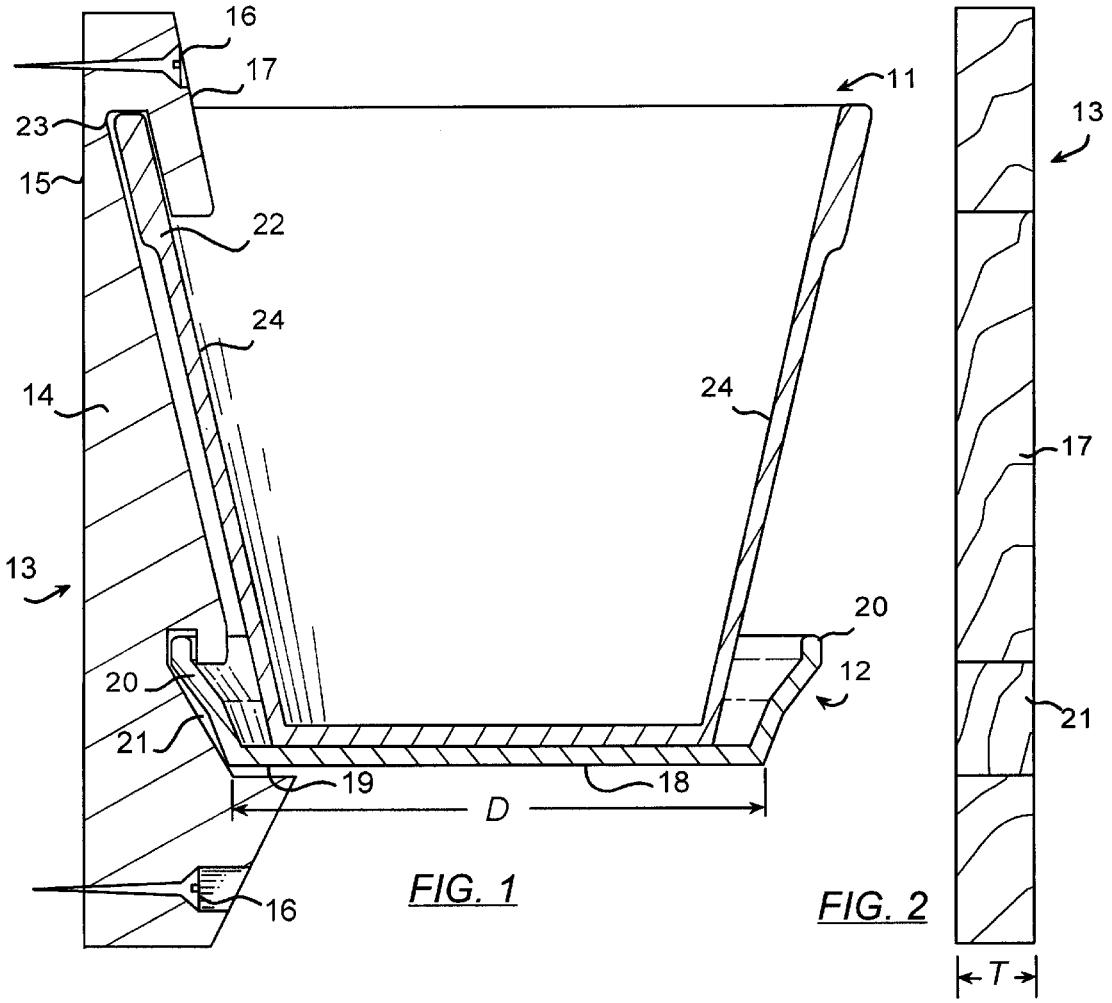
FIG. 1 is a cross-sectional view of a display structure plate or tray, and a mounting bracket.
FIG. 2 is a front view of the mounting bracket.

Referring now to the drawing, there is shown in FIGS. 1 and 2 an empty flower pot 11 mounted on a circular tray 12 supported together by a bracket 13. The bracket comprises a plate 14 having a vertical back edge 15 to be applied and secured to a support structure, not shown on the drawing, by means of fasteners 16 engaged from a generally vertical working edge 17 of the plate, opposite the back edge 15.

The tray 12 shown in the drawing as a shallow dish, comprises a planar bottom section 18 of a given diameter D including a peripheral edge 19, and a substantially vertical, although sightly slanted outwardly, flange 20.

A notch 21 cut into lower section of the working edge 17 of the plate is shaped and dimensioned to capture and retain the flange 20 and peripheral edge 19 of the tray. Due to the commensurate outlines of the notch on one hand, and the flange and peripheral edge of the tray on the other, the tray is held in a cantilevered, horizontal position when the bracket is secured to a wall or other vertical structure.

The flower pot 11 has a slightly reinforced brim 22 similarly captured by an additional notch 23 also cut into the working edge 17 of the plate at as distance above the first-described notch 21 corresponding to the size of the pot wall 24. The width of the additional notch is commensurate with the thickness of the brim 22. The additional notch, not only positions and immobilizes the flower pot over the tray, but also supports wholly or in part the weight of the pot, thus alleviating the stress applied to the flange 20 depending upon how tightly the brim of the pot is retained by the additional notch 23.

The best lateral stability of the tray is obtained when the thickness T of the plate 14 fall within 10% to 15% of the diameter D of tray in the case of a circular one.

Figure 3:
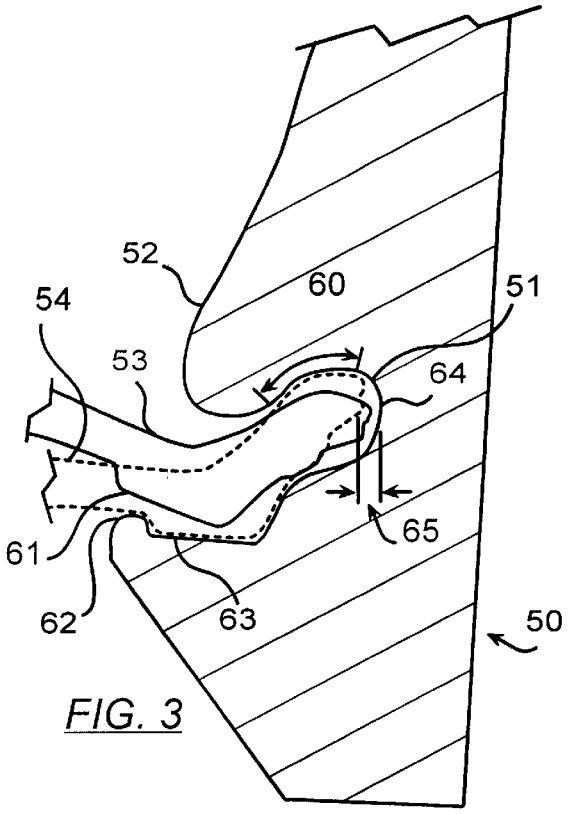
FIG. 3 is a diagrammatical cross-sectional view of an edge of a tray being inserted into an alternate embodiment of the bracket.

The brims of pots and the flanges of trays come in a wide variety of shapes and sizes. Therefore, care must be taken to properly shape and dimension the notches which receive them. Referring now to FIG. 3, there is shown a notch 51 cut into a working edge 52 of a lower section of a bracket 50. A cross-sectional flange of a tray 53 is shown in solid lines being inserted into the notch. The tray in a seated position 54 is shown in dotted lines. Various structural features of the flange are exploited or accommodated by the profile of the notch. First, the tray flange is more outwardly slanted than the embodiment of FIG. 1. Therefore, when fully seated, the notch profile has been shaped to provide a longer zone of contact 60 with the upper and inward facing surfaces of the flange so as to more evenly distribute the cantilevering forces. Second, the tray flange has a downward projecting peripheral bead 61 common to plates and dishes. The notch profile exploits the bead by having a nib 62 projecting upward from an outer portion of the lower surface 63 of the notch. Optionally, the lower surface can be contoured to enwrap the bead as shown. Finally, the rear wall 64 of the notch must be located to provide sufficient clearance 65 for the end of the flange during insertion/extraction of the tray.

Figure 12:
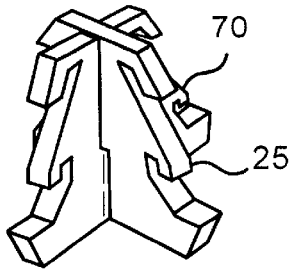
FIG. 12 is a perspective view of a free-standing table top display stand.

As illustrated in FIGS. 4–10, a variety of tray-and-pot securing brackets are disclosed for attachment by insertion over the edges or into slots which may be cut into different types of supporting structures. The bracket 25 of FIG. 4 features two opposite working edges 26, 27. A vertical slot 28 cut into the bottom edge of the plate may be engaged over the top edge of a panel having a thickness substantially equivalent to the width W of the slot 28. Alternately the bracket may be mounted through a slot in a similar panel as will be explained in connection with FIG. 11. Further, as shown in FIG. 12, this bracket 25 may be combined with a similar bracket 70 having a complimentary vertical slot cut into the top edge of its plate to form a free-standing interlocked pair display.

Figure 4:
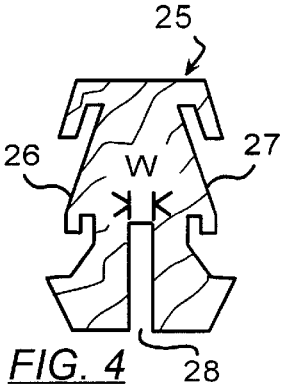
FIGS. 4–6, 8 and 10 are side views of a variety of mounting brackets.
Figure 5:
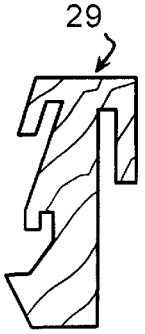

The third embodiment of the bracket 29 of FIG. 5 is a single working face version of the bracket 25 of FIG. 4. It may also be mounted over the top edge of a panel or in a slot therethrough.

Figure 6:
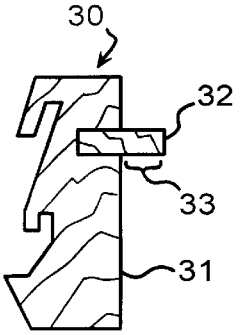
Figure 7:
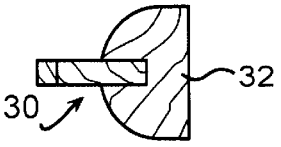
FIG. 7 is a top plan view of the bracket illustrated in FIG. 6.

The fourth embodiment of the bracket 30 illustrated in FIGS. 6 and 7 has a straight vertical back edge 31 intercepted at a right angle by a shelf 32. The part 33 of the shelf projecting back beyond the back edge 31 may be inserted into a commensurate horizontal slot in a panel or wall, or fastened to the horizontal ledge of a shelf, fence, railing or like structure.

Figure 8:
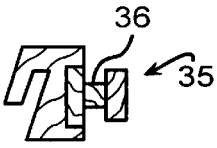
Figure 9:
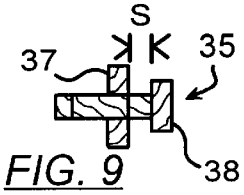
FIG. 9 is a top plan view of the bracket illustrated in FIG. 8.
Figure 10:
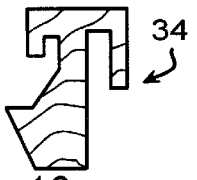

In the fifth embodiment of the bracket illustrated in FIGS. 8–10, a bottom bracket 34 is used to hold a tray, and a separate top bracket 35 is used to hold the pot. Both brackets are designed to be secured in the same vertical slot of a panel. The bottom bracket 34 assuming a fixed position, and the top bracket 35 being ajustably located above the bottom bracket according to the height of the pot as will be explained below. The bottom or tray bracket 34 can be secured with any one of the attachment means already disclosed. The top or pot bracket 35 has a rearward projection or spur 36 having transversal barriers 37, 38 respectively positioned at opposite ends. The spacing S between the barriers must be slightly larger than the thickness of the supporting panel.

Figure 11:
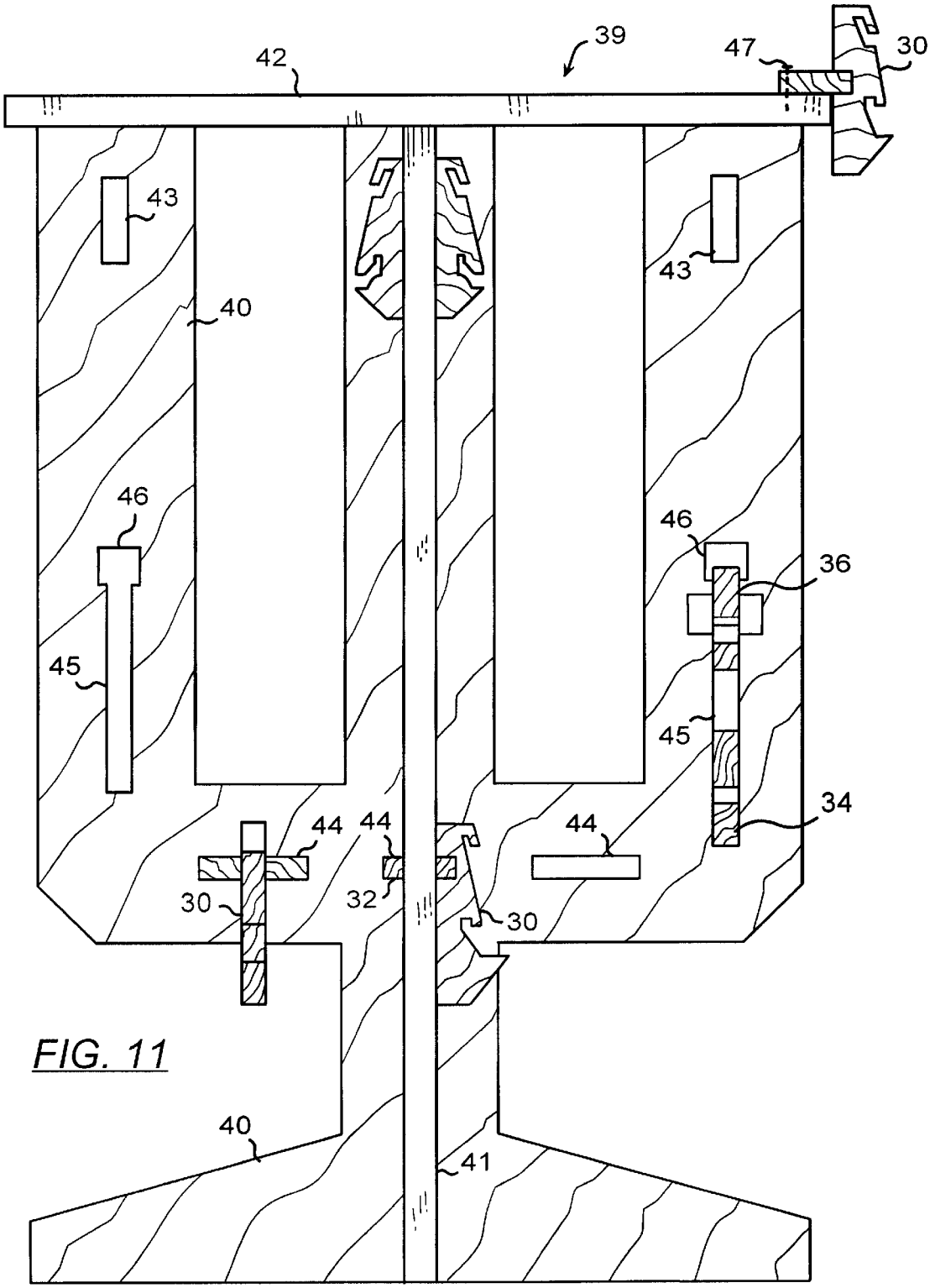
FIG. 11 is a front elevational view of a display stand.

The support structure 39 for a number and variety of tray and pots as illustrated in FIG. 11, comprises two symmetrical panels 40, 41 intercepting each other at a right angle. For the sake of esthetics, the panels have been cut in the candelabra shape of a Saguaro cactus. Various other designs may be accommodated. Together the panels form a stable and multifaced support for a table top 42. A variety of vertical and horizontal slots have been cut through the panels to receive and mount the several types of brackets already described. For instance, the vertical slots 43 located just below the table top can accept either the second or the third described embodiments of the brackets 25, 29. The horizontal slots 44 in the lower parts of the panel can accept the fourth embodiment of the bracket 30. A series of elongated slots 45 are designed to accommodate the height-adjustable tray and pot bracket combination of FIGS. 8–10. The enlarged area 46 at the top of the slots 45 are shaped and dimensioned to pass the back barrier 38 of the spur 36 in the pot-retaining bracket 35. That bracket can then be slid down to the desired height in relationship to the tray-retaining bracket 34. The thickness of the supporting panel is thus securely sandwiched between the two barriers 37, 38 of the spur. It should be noted that the location of the slots in panel 41 may be offset to allow space for the pots of both panels.

A fourth embodiment of the bracket 30 is shown secured to the edge of the table top 42 via a fastener 47. Although not shown on the drawing, the table top 42 may be cut through to receive additional trays or pots. It thus can be understood that the disclosed support structure 39 provides an attractive and practical means to display a large number and variety of flower arrangements over a very limited floor space. Care must be taken that the thickness of the panels 40, 41 correspond to the width of the bracket plates when the second, third and fifth embodiments of the bracket are used.

It should also be understood that the profiles of the notches that are to receive and hold the brims of the pots and the flanges of the trays should for maximum stability correspond as much as practically feasible to the outlines of those brims and flanges while allowing room for insertion and extraction of pots and trays.

While the preferred embodiments of the invention have been described, modifications can be made and other embodiments may be devised without departing from the spirit of the invention and the scope of the appended claims.

What is claimed is:

1. A support apparatus for displaying an article, wherein said apparatus comprises:

a tray having a substantial flat and horizontal central portion, of a given diameter and a flange projecting in a generally upward direction from a peripheral edge of said central portion, and a bead projection in a generally downward direction from said peripheral edge, said flange and peripheral edge having a generally L-shaped cross-section; and a mounting bracket comprising a plate of a given thickness having a lower edge, a first substantially vertical edge, and a first notch in said vertical edge, said notch being generally commensurate with said L-shaped cross-section;

wherein said first notch defines a first lower surface and a nib extending upward from said lower surface;

whereby said tray is held and retained by said bracket when said flange and peripheral edge are inserted into said first notch and said bead is contacted by said first lower surface.

2. The apparatus of claim 1, wherein said bracket further comprises means for attachment to a support structure.

3. The apparatus of claim 2, wherein said plate has a second substantially vertical edge opposite said first edge, said second edge having a second notch substantially commensurate with a L-shaped cross-section of a second tray peripheral edge and flange.

4. The apparatus of claim 3, wherein said means for attachment comprise a vertical slot of a given width cut into said lower edge.

5. The apparatus of claim 4 which further comprises a mounting panel having generally planar front and back faces and a thickness substantially commensurate with said given width;

whereby said vertical slot can be engaged over an edge of said panel.

6. The apparatus of claim 1, wherein said means for attachment comprises a vertical slot of a given width cut into said lower edge.

7. The apparatus of claim 6 which further comprises a mounting panel having generally planar front an back faces and a thickness substantially commensurate with said given width; whereby said vertical slot can be engaged over said panel.

8. The apparatus of claim 1, wherein said notch has a rear terminus extended rearward a distance to facilitate insertion/extraction of said tray.

9. The apparatus of claim 1, wherein the given thickness of said plate ranges between approximately 10% to 15% of said given diameter.

10. A support apparatus for displaying an article, which comprises:

a tray having a substantial flat and horizontal central portion, of a given diameter and a flange projecting in a generally upward direction from a peripheral edge of said central portion, said flange and peripheral edge having a generally L-shaped cross-section; and a mounting bracket comprising a plate of a given thickness having a lower edge, a first substantially vertical edge, and a first notch in said vertical edge, said notch being generally commensurate with said L-shaped cross-section;

whereby said tray is held and retained by said bracket when said flange and peripheral edge are inserted into said first notch;

wherein said bracket further comprises means for attachment to a support structure;

wherein said plate has a second substantially vertical edge opposite said first edge, said second edge having a second notch substantially commensurate with a L-shaped cross-section of a second tray peripheral edge and flange;

wherein said means for attachment comprise a vertical slot of a given width cut into said lower edge;

a mounting panel having generally planar front and back faces and a thickness substantially commensurate with said given width;

whereby said vertical slot can be engaged over an edge of said panel; and wherein said panel has at least one opening therethrough shaped and dimensioned to pass said plate.

11. The apparatus of claim 10 which further comprises a second mounting panel secured to, and intersecting said first panel at substantially orthogonal angle.

12. The combination of a container having an open top and a peripheral rim with a support apparatus comprising a tray having a substantial flat and horizontal central portion, of a given diameter and a flange projecting in a generally upward direction from a peripheral edge of said central portion, and a bead projection in a generally downward direction from said peripheral edge, said flange and peripheral edge having a generally L-shaped cross-section; and a first mounting bracket comprising a first plate of a given thickness having a lower edge, a first substantially vertical edge, and a first notch in said vertical edge, said notch being substantially commensurate with said L-shaped cross-section;

wherein said first notch defines a first lower surface and a nib extending upward from said lower surface;

whereby said tray mounting said container may be retained and held by said mounting bracket when said flange and peripheral edge are inserted into said first notch and said bead is contacted by said first lower surface.

13. The combination of claim 12, wherein said plate has an additional notch in said first substantially vertical edge, said additional notch being positioned, shaped, and dimensioned to capture a section of said peripheral rim.

14. The combination of claim 12 which further comprises a second mounting bracket comprising a second plate having first and second generally vertical edges, a upwardly slanted notch in said first generally vertical edge, said notch being shaped and dimensioned to capture a section of said peripheral rim; and means for securing said second mounting bracket at an adjustable distance above said first mounting bracket.

15. The combination of claim 14, wherein said means for securing comprise a panel having a generally vertical slot shaped and dimensioned to slidingly engage said second plate.

* * * * *